US006129838A

United States Patent [19]

Millner

[11] Patent Number: 6,129,838

[45] Date of Patent: Oct. 10, 2000

[54] DRAIN GRATE

[76] Inventor: David Millner, 8363 Dynasty Dr., Boca Raton, Fla. 33433

[21] Appl. No.: 09/065,983

[22] Filed: Apr. 24, 1998

Related U.S. Application Data

[60] Provisional application No. 60/060,041, Sep. 25, 1997.

[51] Int. Cl.[7] ..... E03F 1/00

[52] U.S. Cl. ..... 210/164; 52/302.1

[58] Field of Search ..... 210/163, 164, 210/165, 495; 405/43, 45; 404/2, 3, 4; 52/11, 12, 169.5, 302.1, 302.3

[56] References Cited

U.S. PATENT DOCUMENTS

| | | |
|---|---|---|
| 355,330 | 1/1887 | Locke . |
| 1,584,986 | 5/1926 | Fleming . |
| 4,185,429 | 1/1980 | Mendola . |
| 4,235,008 | 11/1980 | Meredith . |
| 4,490,067 | 12/1984 | Dahowski . |
| 4,598,277 | 7/1986 | Feldman . |
| 5,275,506 | 1/1994 | Grimsley . |

*Primary Examiner*—David A. Simmons
*Assistant Examiner*—Fred Prince

[57] ABSTRACT

A drain grate for installation within a concrete deck, along a periphery of the deck and below a base frame structure of a screen enclosure for draining water from the deck surface includes an elongate channel having a top plate with an exposed upper face, a bottom plate, and side walls extending between the top and bottom plates to define an interior fluid passageway therebetween. The top plate is provided with drain openings at close spaced intervals therealong and a rear side wall includes elongate drain slots permitting fluid flow from the interior passage to an exterior of the channel. When installed, the upper face of the channel is flush with the deck surface so that water accumulating on the deck surface is directed through the drain openings and into the interior passage of the drain grate from which it exits at the elongate drain slots on the rear wall and on to the grass or ground surface beyond the screen enclosure and deck.

5 Claims, 2 Drawing Sheets

DRAIN GRATE

BACKGROUND OF THE INVENTION

This patent application is based on provisional patent application Ser. No. 60/060,041 filed on Sep. 25, 1997.

FIELD OF THE INVENTION

The present invention relates to drain grates and, more particularly, to a drain grate for installation within a concrete or like material deck.

DESCRIPTION OF THE RELATED ART

Many homes have an outside cement, concrete or like material deck adjacent the house. Commonly, a screen enclosure is installed above and around the deck to provide an outdoor entertainment area that is shielded from pests such as mosquitoes, gnats, flies, and the like.

Typically, the surface of the deck is higher than the surrounding ground surface which is usually grass or dirt. The frame structure of the screen enclosure includes a base rail or track which mounts to the top surface of the deck about the periphery thereof, adjacent the surrounding ground surface. The base rail of the screen enclosure frame structure is approximately 1" to 1½" in height and when mounted to the deck surface, forms a raised lip which prevents water from flowing off of the deck surface and onto the surrounding ground surface. In most instances, decks are sloped to direct water towards the corners. The raised lip created by the base rail, preventing the water from flowing off of the deck surface, causes rain water, pool water, and the like to accumulate in the corners. In a short time, the persistent accumulation of standing water causes mildew, mold and discoloration of the deck.

In the past, attempts have been made to drain water from screen enclosed decks by drilling holes through the base rail of the screen enclosure frame structure. Initially, this drainage method is effective. However, over time, the holes through the base rail become clogged with leaves, dirt, insects and the like which obstruct drainage.

Accordingly, there is an urgent need in the related field for a drain grate which is specifically structured for installation within concrete, cement and like material decks, adjacent the base rail of a screen enclosure to effectively drain water from a top surface of the deck to an area exterior of the screen enclosure.

SUMMARY OF THE INVENTION

The present invention is directed to a drain grate for installation within a concrete deck, along a periphery of the deck and below a base frame structure of a screen enclosure for draining water from the deck surface to an exterior of the screen enclosed area. The drain grate includes an elongate channel having a top plate with an exposed upper face, a bottom plate, and side walls extending between the top and bottom plates to define an interior fluid passageway therebetween. The top plate is provided with drain openings at close spaced intervals therealong. A rear side wall includes elongate drain slots permitting fluid flow from the interior passage to an exterior of the channel. When installed, the upper face of the channel is flush with the deck surface and the drain openings are exposed inwardly of the peripheral edge of the deck and the base frame structure of the screen enclosure. The rear wall is flush with the peripheral edge of the deck so that the elongate drain slots are disposed on the exterior of the screen enclosure. Water accumulating on the deck surface is directed through the drain openings and into the interior passage of the drain grate. Thereafter, the water exits the elongate drain slots and is deposited on to the grass or ground surface beyond the screen enclosure and deck. The drain grate may be constructed to fit within a corner of the deck, wherein channels are assembled in an L-shaped configuration, including two legs disposed in perpendicular relation, each being of equal length. In this manner, water which normally accumulates in the corners of screen enclosed decks can be efficiently and effectively drained to maintain the deck surface dry and clean.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Referring to the several views of the drawings, the present invention, directed to drain grate, is shown and generally indicated as 10.

Figure 3:
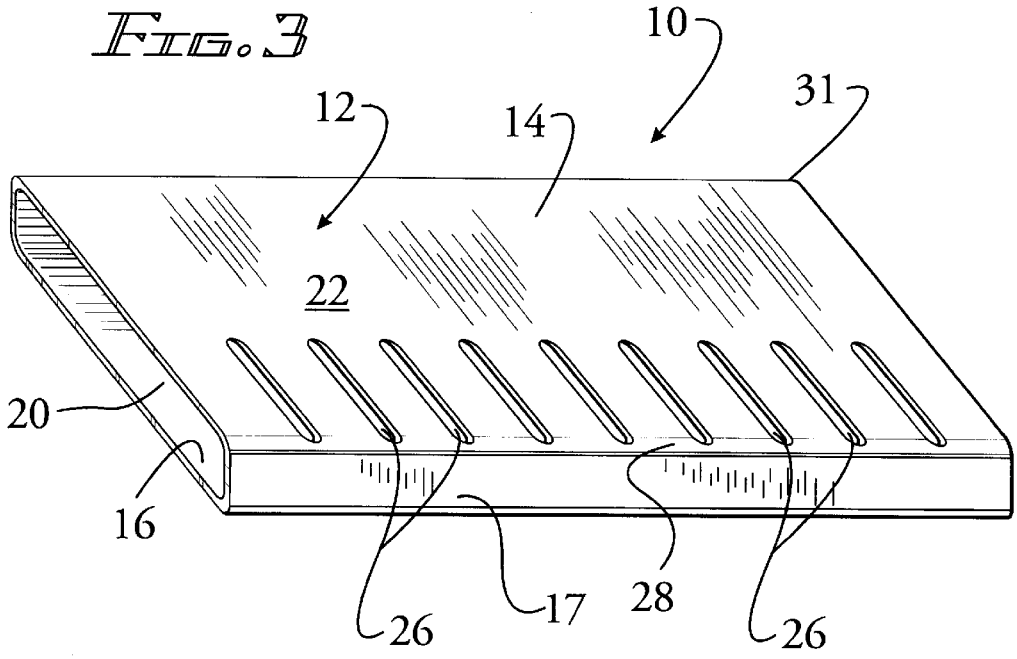
FIG. 3 is a top front perspective view of the drain grate.
Figure 4:
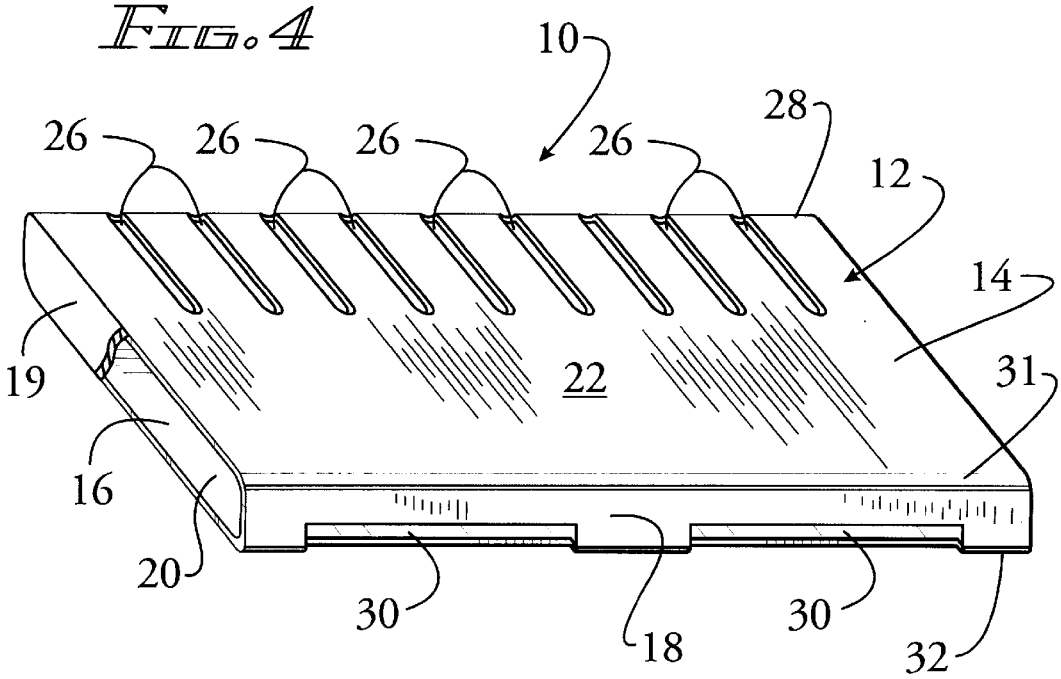
FIG. 4 is a top rear perspective view of the drain grate.

Referring initially to FIGS. 3 and 4, the drain grate 10 includes an elongate channel 12 formed of aluminum, stainless steel, polyvinyl chloride, or other suitable material. The channel 12 may be manufactured by extrusion molding, roll forming, bending or other well known manufacturing methods and techniques commonly used in the relevant industry.

The channel 12 includes a top plate 14, a bottom plate 16, and opposite side walls including a front side wall 17 and a rear side wall 18. End walls 19 may further be provided at opposite ends of the channel 12, as shown in FIG. 4. The top wall 14 and bottom wall 16 are spaced from each other and, together with the side walls 17, 18, they surround an interior passage 20 for fluid flow therethrough. The top plate includes an upper exposed face 22 having an array of elongate drain openings 26 formed therethrough at spaced intervals and extending perpendicularly from a top front edge 28 towards a central zone of the top plate. The rear wall 18 includes elongate drain slots 30 formed through the thickness of the wall, below a rear top edge 31 and adjacent a rear bottom edge 32, in fluid flow communication with the interior passage 20.

Figure 1:
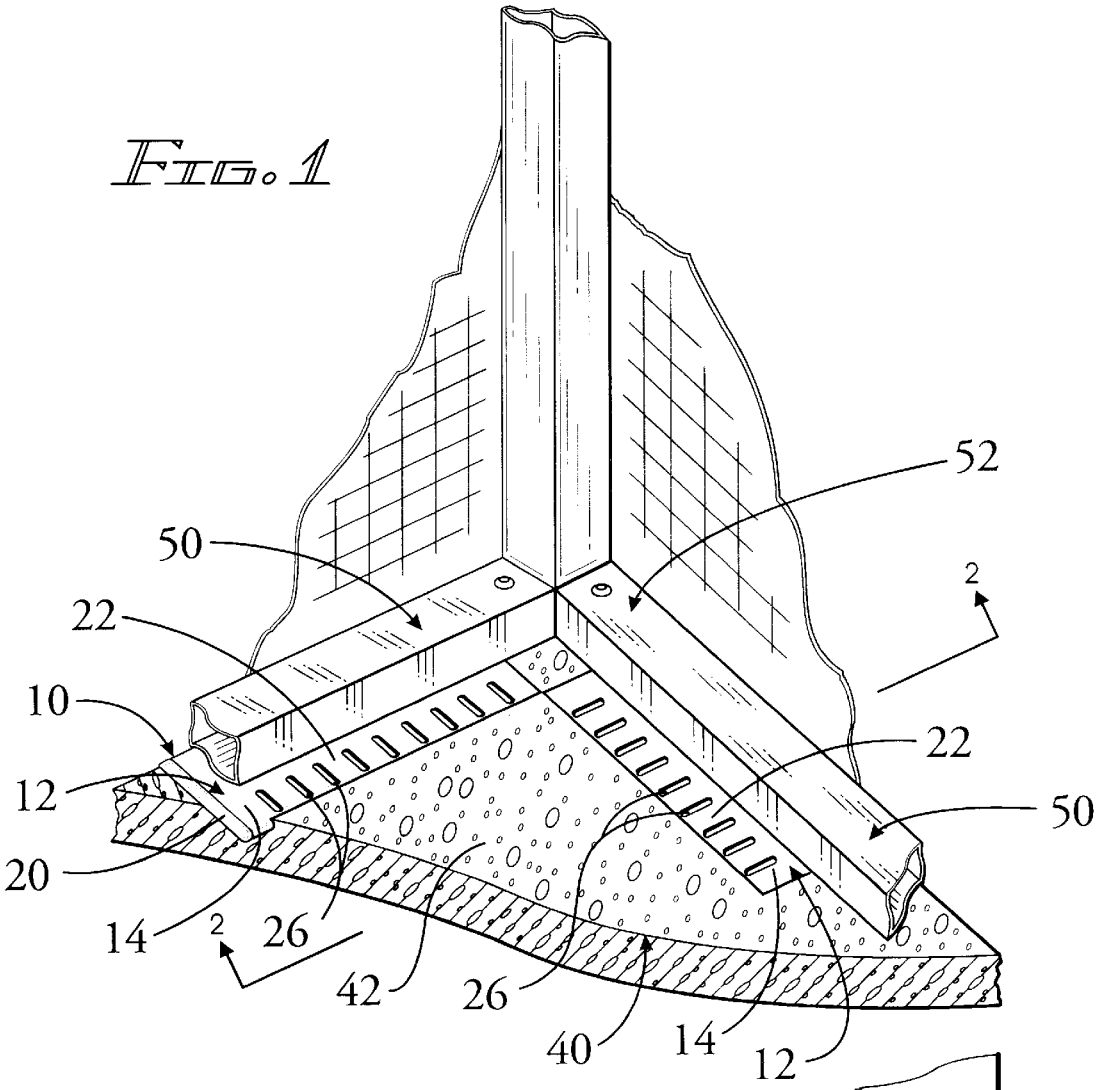
FIG. 1 is a top perspective of a screen enclosure and deck surface with the drain grate installed in a corner of the deck.
Figure 2:
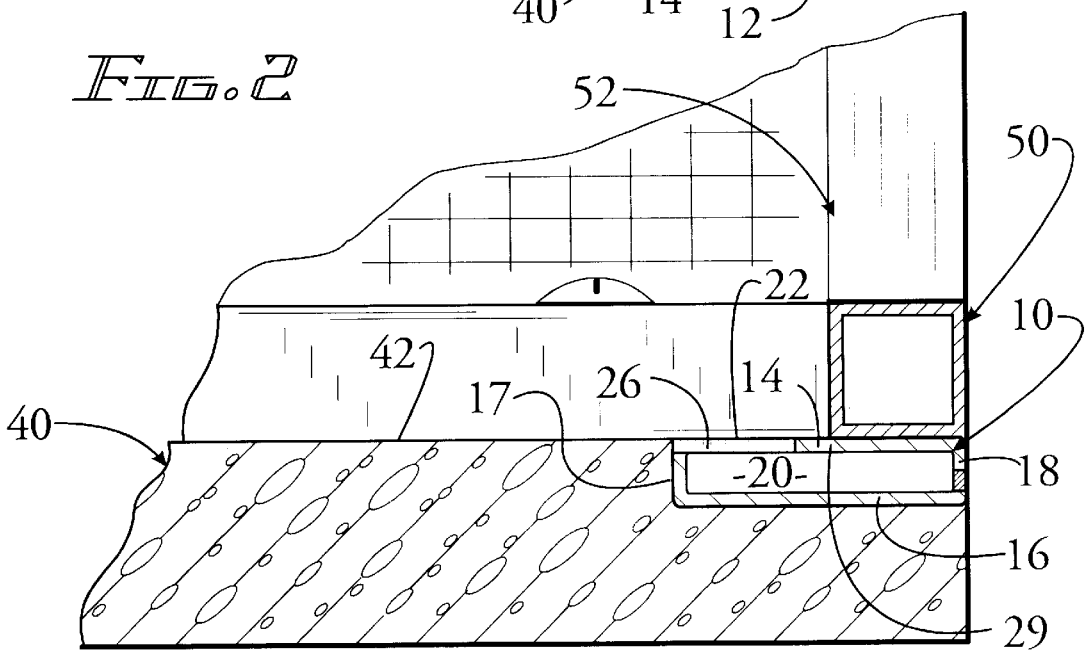
FIG. 2 is a cross-sectional view taken along line 2—2 of FIG. 1.

As seen in FIG. 1, when the drain grate 10 is installed, the upper face is flush with the deck surface 42. This is accomplished by recessing the drain grate 10 within the deck 40 either during initial installation of the deck or by cutting an area in an existing concrete deck to form a cavity for receipt of the drain grate 10 therein. The depth of the cavity should be the same as the height of the drain grate 10 which is approximately 1". Further, when the drain grate 10 is installed, an outboard zone 29 of the upper face of the drain grate is positioned underneath the base rail 50 of the screen enclosure frame structure 52. The width of the top plate, measured between the top front and rear edges 28, 31, should be at least five inches and preferably six inches so that the base rail 50 does not cover the drain openings 26. Water which is directed towards the corner or outer perimeter of the deck, due to the slope of the deck, passes through the drain openings and interior passage 20 of the drain grate, exiting the drain grate through the elongate drain slots to an exterior of the screen enclosure and onto the ground surface, such as surrounding grass or a garden.

While the instant invention has been shown and described in accordance with what is believed to be preferred and practical embodiments thereof, it is recognized that departures may be made from the instant disclosure within the spirit and scope of the present invention.

What is claimed is:

1. A drain grate for draining fluid from a deck surface, comprising:

an elongate channel including a flat top plate, a bottom plate, a front side wall and a rear side wall surrounding an interior fluid passage, and an elongate front top edge extending along a length of said channel between said top plate and said front side wall;

said top plate including a plurality of drain openings formed therethrough and in fluid flow communication with said interior fluid passage;

at least one discharge opening formed through said rear side wall, adjacent to said bottom plate and in fluid flow communication with said interior fluid passage; and wherein said elongate channel is structured to direct fluid flow through said drain openings and said interior fluid passage and out from said at least one discharge opening.

2. A drain grate as recited in claim 1 wherein said plurality of drain openings are elongate slots disposed in parallel relation to one another and extending perpendicularly from said elongate front edge.

3. A drain grate as recited in claim 1 wherein said channel further includes a rear top edge extending along a length of said channel between said top plate and said rear side plate and wherein a width of said top plate, measured transversely between said front top edge and said rear top edge, is at least five inches.

4. A drain grate as recited in claim 1 wherein said channel further includes end walls at opposite ends of said interior fluid passage.

5. A drain grate for draining fluid from a deck surface of a deck having a perimeter, said drain grate comprising:

an elongate channel including a top plate having an exterior surface structured and disposed to be flush with said deck surface, a rear side wall structured and disposed to be positioned along the perimeter of the decks below the deck surface and an interior fluid passage communicating between said top plate and said rear side wall; and means for directing fluid flow from said exterior surface of said top plate, through said interior fluid passage, and out from said rear side wall.

* * * * *